US006090016A

United States Patent [19]

Kuo

[11] Patent Number: 6,090,016

[45] Date of Patent: Jul. 18, 2000

[54] COLLAPSIBLE TREADER WITH ENHANCED STABILITY

[76] Inventor: Hai Pin Kuo, Chi-Lu-Chien No. 30, Pao-an Tsun, Jen-Te Hsiang, Tai-Nan Hsien, Taiwan

[21] Appl. No.: 09/195,146

[22] Filed: Nov. 18, 1998

[51] Int. Cl.[7] ..... A63B 22/02

[52] U.S. Cl. ..... 482/54

[58] Field of Search ..... 482/54

[56] References Cited

U.S. PATENT DOCUMENTS 931,394 8/1909 Day ..... 482/54

5,743,833 4/1998 Watterson et al. ..... 482/54

5,816,981 10/1998 Hung ..... 482/54

*Primary Examiner*—Glenn E. Richman

*Attorney, Agent, or Firm*—A & J

[57] ABSTRACT

A collapsible treader with enhanced stability including U-shaped front and rear frames forming a rectangular base frame, a substantially H-shaped frame secured at a bottom end of two side wings of an opening of the front frame, and a retention mechanism disposed at one side wing of said rear frame. The retention mechanism includes a rear wheel mounting bar adapted to contact the floor so that a retention bolt of a rod may urge against a bottom side of one side bar of the intermediate frame so that the entire base frame may be firmly supported on the floor without moving or shaking.

2 Claims, 5 Drawing Sheets

COLLAPSIBLE TREADER WITH ENHANCED STABILITY

BACKGROUND OF THE INVENTION

1. Field of the Invention

The present invention relates generally to a collapsible treader with enhance stability, and more particularly to a collapsible treader that is spacesaving and that will not move or shake when in operation.

2. Description of the Prior Art

Treaders are a common type of exercising apparatus. However, compared to rowers, exer-bikers, and exer-bikes, treaders are relatively large and bulky and, when used in the home, occupy large floor space and appear obtrusive. The size of treaders may be a factor that discourages more people from installing them at home for exercising.

SUMMARY OF THE INVENTION

The present invention relates generally to a collapsible treader with enhance stability, and more particularly to a collapsible treader that is spacesaving and that will not move or shake when in operation.

A primary object of the present invention is to provide a collapsible treader with enhanced stability which, when not in use, may be collapsed to save floor space.

Another object of the present invention is to procvide a collapsible treader with enhanced stability which is provided with a locking mechanism to ensure that the treader is positively locked in position when collapsed so as to ensure safety.

A further object of the present invention is to provide a collapsible treader with enhanced stability which, when in use, will not move or shake due to its collapsible configuration.

The foregoing objects and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENT

Figure 1:
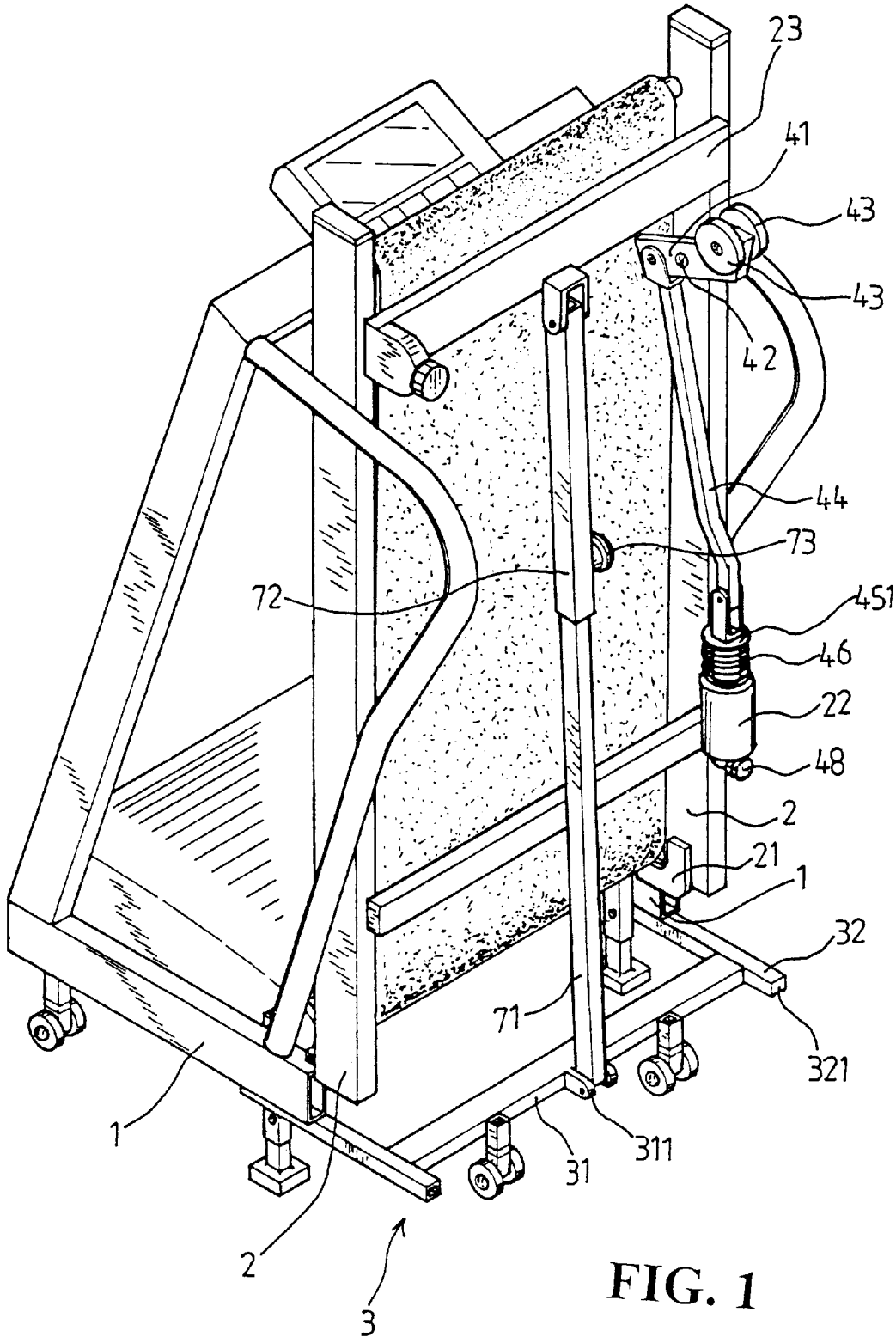
FIG. 1 is a perspective view of the present invention in a collapsed state.

For the purpose of promoting an understanding of the principles of the invention, reference will now be made to the embodiment illustrated in the drawings. Specific language will be used to describe same. It will, nevertheless, be understood that no limitation of the scope of the invention is thereby intended, such alterations and further modifications in the illustrated device, and such further applications of the principles of the invention as illustrated herein being contemplated as would normally occur to one skilled in the art to which the invention relates.

Figure 4:
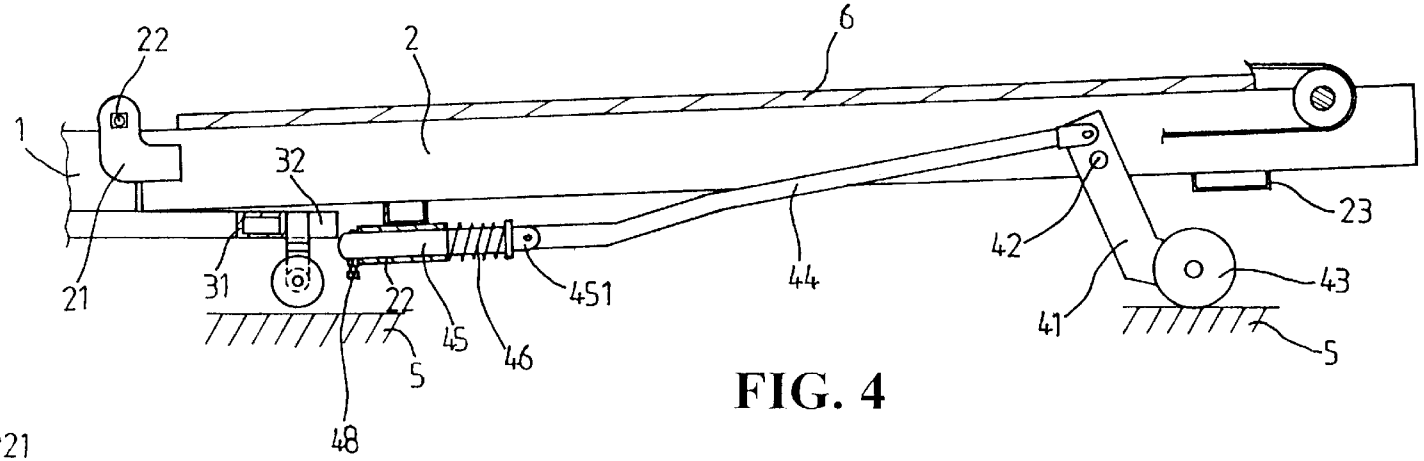
FIGS. 4 and 5 are schematic views of the retention mechanism of the present invention.
Figure 5:
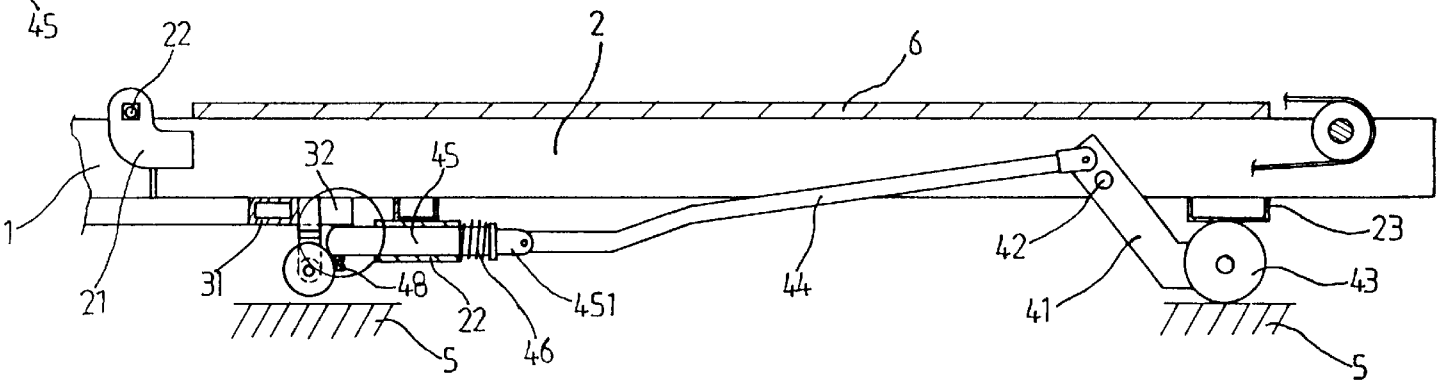

Referring to FIG. 1, the treader according to the present invention comprises a U-shaped front frame 1 and a rear frame 2. The rear frame 2 is provided with substantially L-shaped plates 21 (see FIGS. 4 and 5) at front ends of two side wings of its opening. One end of the L-shaped plate 21 is pivotally mounted on the front frame 1 by a pin 22, whereby the rear frame 2 may use the pins 22 provided at both sides as pivots to be able to be movalby erected upside down in a collapsible state. When the rear frame 2 is put down to lie in a horizontal position with the front frame 1, the treader of the present invention is ready for use.

Figure 2:
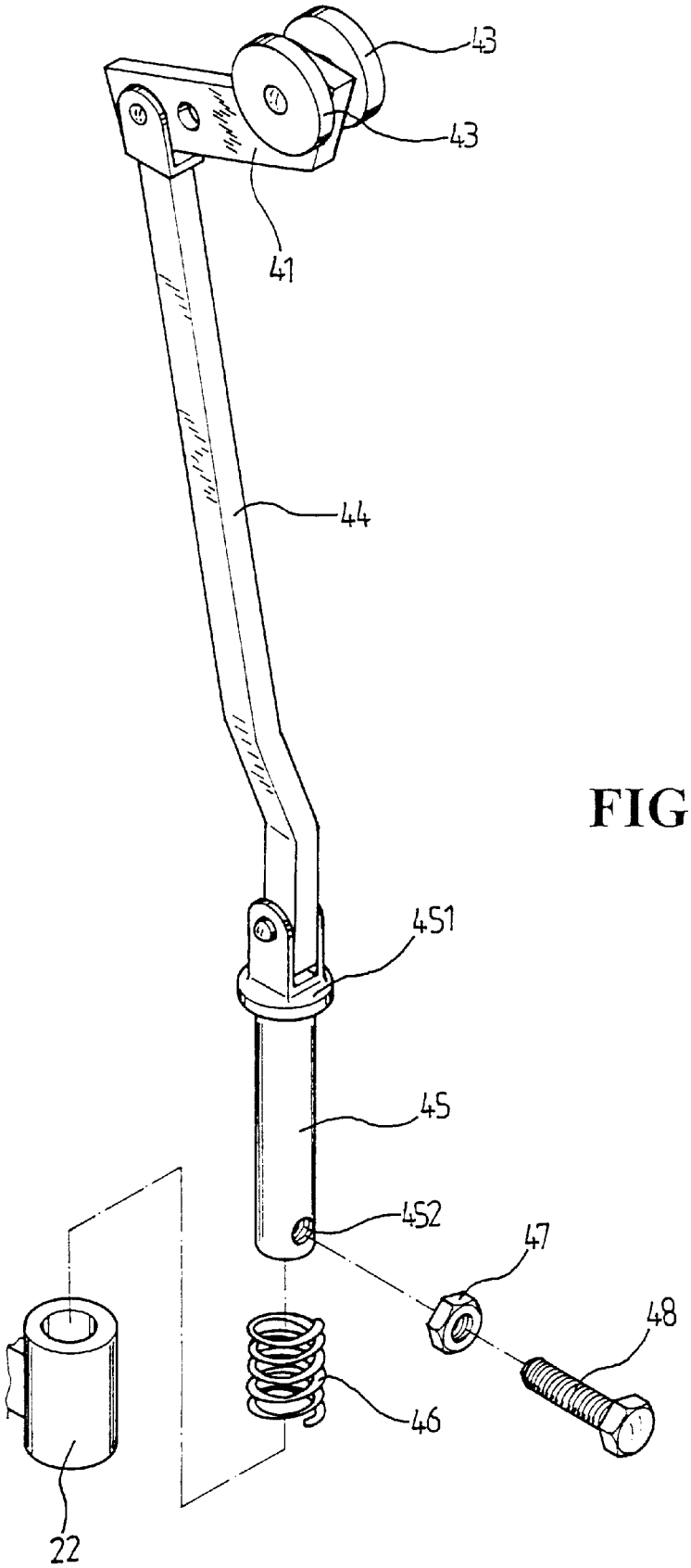
FIG. 2 is an exploded view of a retention mechanism of the present invention.

The front frame 1 is provided with a substantially H-shaped intermediate frame 3 at a bottom end of two side wings at its opening side. One of the side bar 32 of the intermediate frme 3 is provided with a curved groove 321 of a suitable length on the surface of its bottom portion. The rear frame 2 further has a retention mechanism 4 provided on one of the side wings at its opening side. Referring to both FIGS. 1 and 2, the retention mechanism 4 includes a rear wheel mounting bar 41 that is pivotally mounted on the side wing of the rear frame 2 by pivots 42. One end of the rear wheel mounting bar 41 is proveded with wheel means 43, while the other end thereof is pivotally connected to one end of slightly bent link 44 of a suitable length. The other end of the link 44 is in turn associated with a pivot seat 451 at one end of a rod 45. The rod 45 has a spring 46 fitted thereon and the other end thereof is provided with a threaded hole 452 for receiving an retention bolt 48 having a curved head and fitted with a positioning nut 47. The rod 45 may be inserted into a cylindrical mounting tube provided on the side wing of the rear frame 2 before the retention bolt 48 is inserted into the threaded hole 452 with the curved head slightly projecting from the threaded hole 452. The retention bolt 48 may restrict the rod 45 from withdrawing from the mounting tube 22. At this point, the spring 46 is just located between the pivot seat 451 and the mounting tube 22.

Figure 3:
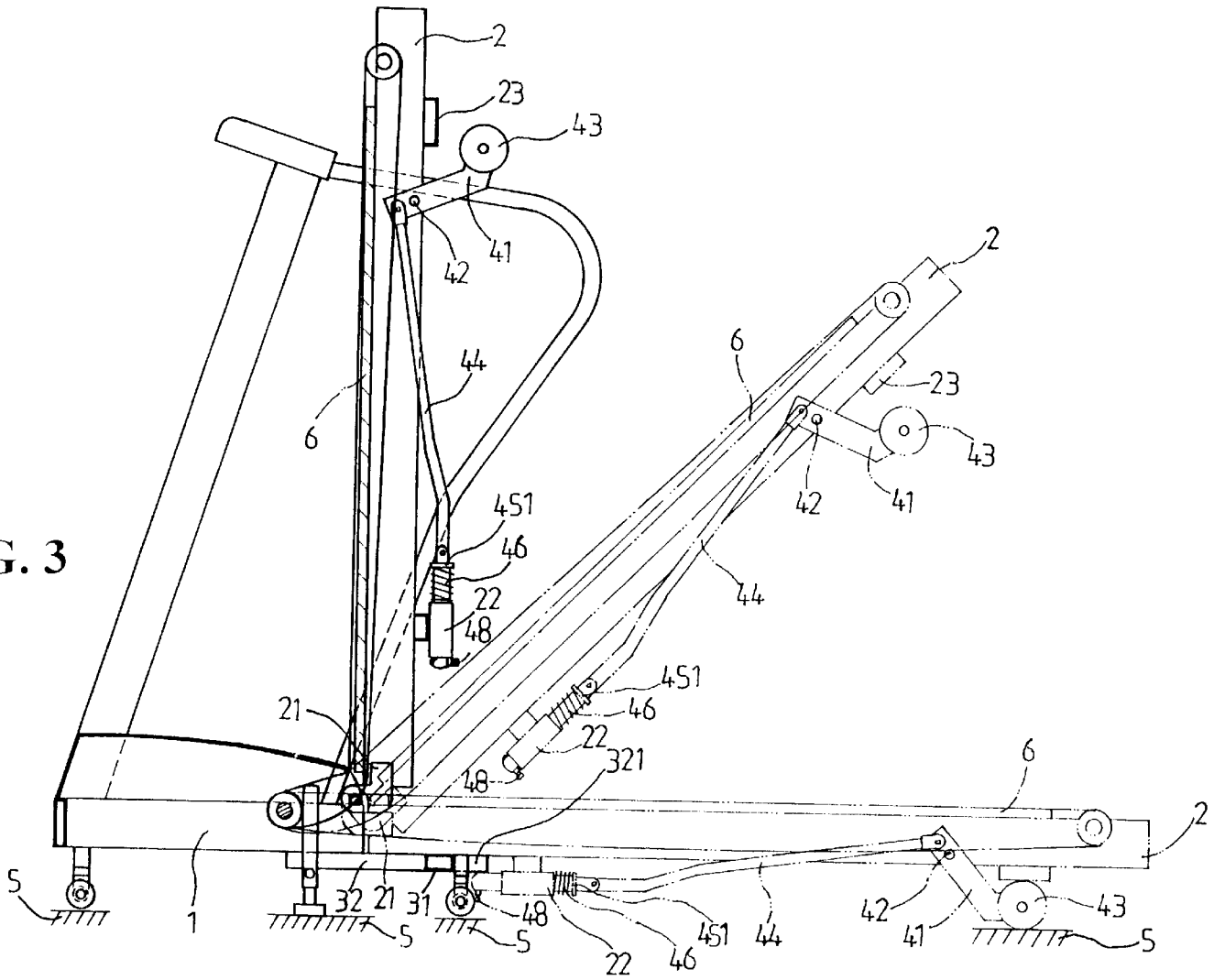
FIG. 3 is a schematic view illustrating the operation of collapsing and putting the treader of the present invention in a ready state.
Figure 6:
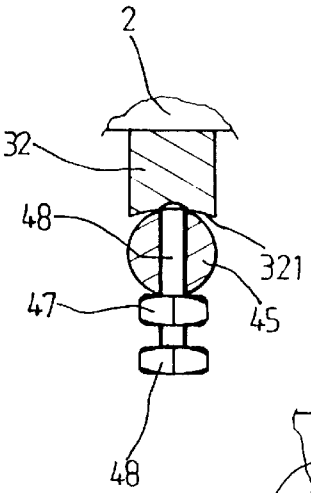
FIG. 6 is an enlarged sectional view of the retention mechanism of FIG. 5.
Figure 8:
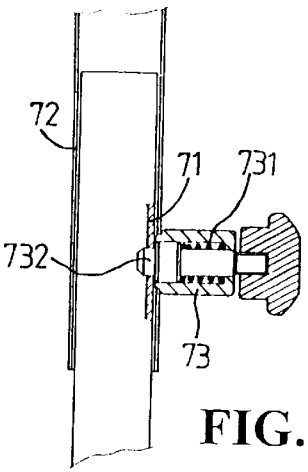
FIGS. 7–9 are respective schematic views illustrating operation of a locking mechanism of the treader of the present invention when the latter is being collapsed.

Referring to FIG. 3, which illustrates how the rear frame 2, in a collapsed state (in solid lines), is put down in a horizontal position (in imaginary lines) ready for use, and vice versa. With reference to both FIGS. 3 and 6, when the rear frame 2 is put down with the rear wheel means 43 contacting the floor 5, when the user exerts a little pressure on a tread belt 6, combined with the weight of the rear frame 2 itself, the rear wheel mounting bar 41 will bias with the pivot 42 as center to cause the link 44 and the rod 45 to displace so that a front end of the rod 45 located at the bottom side of the side bar 32 of the intermediate frame 3. At the same time, by causing the retention bolt 48 to contact closely the curved groove 321 of the side bar 32, the rear frame 2 can be put down in a horizontal position. Besides, the pivotal connection between the front frame 1 and the rear frame 2 is secured. When the user runs on the tread belt 6, the rear frame 2 of the present invention will not move or shake. To compensate wear due to frequent turning of the rear frame 2 with respect to the front frame 1, the user may adjust slightly the depth of the retention bolt 48 in the threaded hole 452 so that the curved head of the retention bolt 48 may maintain an ideal tight contact with the curved groove 321 of the side bar 32. In a reverse operation, the user pulls the rear end of the rear frame 2 upwardly in an erect position. When the rear whell means 43 leaves the floor 5, due to the resilience of the compressed spring, the rod 45 will be pulled rearwardly to a reset position, then the rear frame 2 may be continued to be pulled upwardly to a collapsed state.

Figure 9:
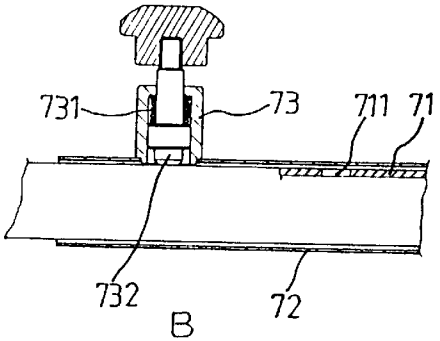
Figure 7:
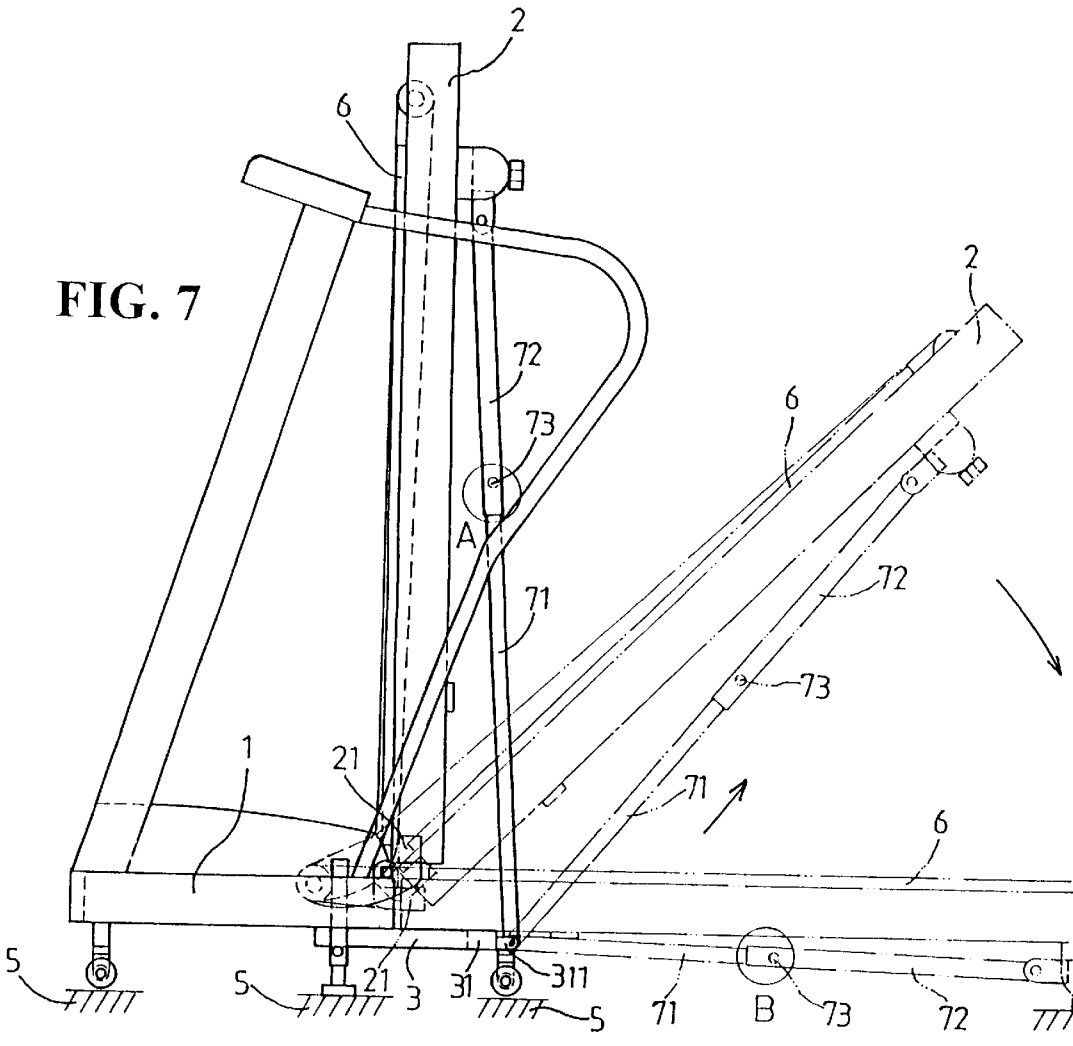

Referring to FIG. 1 and FIGS. 7–9, a locking mechanism 7 is provided between the pivot seat 311 and a horizontal bar 23 at the outer end of the rear frame 2. The locking mechanism 7 includes an inner tube 71, an outer tube 72, and a locking element 73. The locking element 73 is secured on the outer tube 72 and is internally provided with a spring 731 and a lock pin 732 capable of reciprocating movement due to the spring 731 connected to its rear end. When the rear frame 2 is laid flat, the lock pin 732 is in an unlocked position, as shown in FIG. 9. When the rear frame 2 is pulled upwardly, the inner tube 71 extends gradually outwardly from the inside of the outer tube 72 until the lock pin 732 enters a circulay hole 711 of the inner tube 71 (as in FIG. 8). Not only are the inner tube 71 and the outer tube 72 are positively locked in position, the rear frame 2 is also secured in its collapsed position without danger of falling. Safety is ensured. Certainly, to change the treader of the present invention from an erect position to a horizontal position, the user may simply pull out the locking element 73 and put the rear frame 2 slowly down.

In summary, the arrangement of front and rear frames 1 and 2 connected in a pivotal relation achieves a collapsible exerciser treader. And the provision of the locking mechanism 7 secures the position of the rear frame 2 when in a collapsed state, while the retention mechanism 4 ensures that the rear frame 2 will not move or shake when in use.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

I claim:

1. A collapsible treader with enhanced stability, said treader in a position for exercising having a substantially rectangular base frame which comprises:

a substantially U-shaped front frame;

a substantially U-shaped rear frame, having substantially L-shaped plates at respective front ends of two side wings at an opening thereof, said plates being pivotally connected to two side wings at an opening of said front frame by pins;

a substantially H-shaped intermediate frame having two side bars and a transverse bar, said side bars being positioned at a bottom side of said two side wings of said front frame, one of said side bars being provided with a curved groove of a suitable length at the surface of a bottom side thereof, said transverse bar being provided with a pivot seat;

a retention mechanism, said retention mechanismn having a rear wheel mounting bar pivotally connected to one of said side wings of said rear frame by pins, one end of said rear wheel mounting bar having wheel means, the other end thereof being pivotally connected to one end of a slightly bent link of a suitable length, the other end of said link being connected to a pivot seat at one end of a rod, said rod being fitted with a spring and the other end thereof being provided with a threaded hole for receiving a retention bolt having a slightly curved head and fitted with a positioning nut, wherein said rod may be firstly inserted into a cylindrical tube provided on said one of said side wings of said rear frame and then said retention bolt is driven into said threaded hole with said curved head projecting slightly from said threaded hole;

whereby said rear frame may be movably pulled upside down in a collapsed state to save floor space, and when said rear frame is laid flat on the floor for exercising purposes, said rod and said retention bolt of said retention mechanism will urge tightly against said curved groove at the bottom side of said one of said side bars of said intermediate frame to ensure the stability of said rear frame so that said rear frame will not, due to its pivotal connection with said front frame, move or shake during use.

2. The collapsible treader as claimed in claim 1, further comprising a locking mechanism disposed between said pivot seat of said intermediate frame and a transverse bar at an outer end of said rear frame, said locking mechanism including an inner tube, an outer tube, and a locking element, said locking element being secured on said outer tube and internally provided with lock pin and a spring abutting a rear end of said lock pin so that said lock pin is capable of retractable displacement, said inner tube being provided with a circular hole at a suitable position, whereby when said rear frame is laid flat on the floor, said lock pin is in an unlocked position, and when said rear frame is erected, said inner tube gradually extending outwardly from inside said outer tube until said lock pin enters said circular hole to secure said inner and outer tubes in a locked position and to secure said rear frame in a collapsible state in a locked position without danger of falling.

* * * * *